US007641179B2

(12) United States Patent
Sherrard

(10) Patent No.: US 7,641,179 B2
(45) Date of Patent: Jan. 5, 2010

(54) TAMPER-RESISTANT FENCING

(76) Inventor: Jean R. Sherrard, 14378 Sandy Hook Rd. NE., Poulsbo, WA (US) 98370

( * ) Notice: Subject to any disclaimer, the term of this patent is extended or adjusted under 35 U.S.C. 154(b) by 0 days.

(21) Appl. No.: 11/750,937

(22) Filed: May 18, 2007

(65) Prior Publication Data

US 2008/0283810 A1 Nov. 20, 2008

(51) Int. Cl.
*E04H 17/02* (2006.01)

(52) U.S. Cl. ..... 256/32; 256/34

(58) Field of Classification Search ..... 256/32, 256/33, 34, 35, 36
See application file for complete search history.

(56) References Cited

U.S. PATENT DOCUMENTS 934,779 A * 9/1909 Wiley ..... 256/32
2,760,759 A * 8/1956 Rice ..... 256/34
3,285,577 A * 11/1966 Pinson ..... 256/34
3,356,343 A * 12/1967 Taylor ..... 256/34
4,512,556 A * 4/1985 Meglino ..... 256/34
5,056,761 A * 10/1991 Meglino et al. ..... 256/34
5,106,058 A * 4/1992 Finkelstein ..... 256/34
6,966,547 B2 * 11/2005 Colliander ..... 256/32

* cited by examiner

*Primary Examiner*—Michael P Ferguson
(74) *Attorney, Agent, or Firm*—Mark R. Hennings

(57) ABSTRACT

The security of an ordinary fence can be improved by using intersecting inserts that extend between posts of the fence. The inserts can be inserted in channels that are formed by the woven wire of the fence fabric. Intersections of the inserts can be used to securely couple two intersecting inserts to each other by any suitable means such as welding, bolting, riveting, gluing, and the like. The inserts can be securely coupled to the posts either directly (for example, by using a bracket attached to a post) and/or indirectly by using, for example, a tensioning rod that is coupled to a post. The inserts can also be securely coupled to a support rail that spans the distance between two posts.

8 Claims, 3 Drawing Sheets

TAMPER-RESISTANT FENCING

BACKGROUND

Conventional chain link fences are typically made of interwoven wires that are used as a fence fabric. Weaving the wires together often forms familiar diamond-shaped openings that are apparent when fabric is spread out and tensioned between two posts. Vertical and diagonal channels are also usually formed that extend in directions within the plane of the face of the fence. Various types of slats can be inserted into the channels formed by chain link fences for the purpose of obscuring the view through the fence and for providing a greater level of privacy.

The fence fabric is typically supported by posts that are set into the ground and by a horizontal support rail that is supported in turn by the posts. The fence fabric can be tensioned by including vertical tensioning rods in vertical channels (that are usually near each ends of a section of fabric) and by securing under tension one or both of the vertical tensioning rods in opposing ends of the fence fabric to the posts.

Fences are often provided for the purpose of security. However, the wire of a fence fabric is usually of sufficiently small diameter to allow cutting of the wire with common wire cutters and/or bolt cutters. This ease-of-cutting allows fencing to be easily cut by people who wish to breach the security provided by the fence.

SUMMARY

This summary is provided to introduce a selection of concepts in a simplified form that are further described below in the detailed description. This summary is not intended to identify key features or essential features of the claimed subject matter, nor is it intended as an aid in determining the scope of the claimed subject matter.

In general terms, a tamper-resistant fence is disclosed. The security of an ordinary fence can be improved by using intersecting inserts that extend between posts of the fence. The inserts can be inserted in channels that are formed by the woven wire of the fence fabric. Intersections of the inserts can be used to securely couple two intersecting inserts to each other by any suitable means such as welding, bolting, riveting, gluing, and the like. The inserts can be securely coupled to the posts either directly (using a bracket attached to a post) and/or indirectly by using, for example, a tensioning rod that is coupled to a post. The inserts can also be securely coupled to a support rail that spans the distance between two posts.

These and other features and advantages will be apparent from a reading of the following detailed description and a review of the associated drawings. It is to be understood that both the foregoing general description and the following detailed description are explanatory only and are not restrictive. Among other things, the various embodiments described herein may be embodied as methods, devices, or a combination thereof. The disclosure herein is, therefore, not to be taken in a limiting sense.

DETAILED DESCRIPTION

Figure 1:
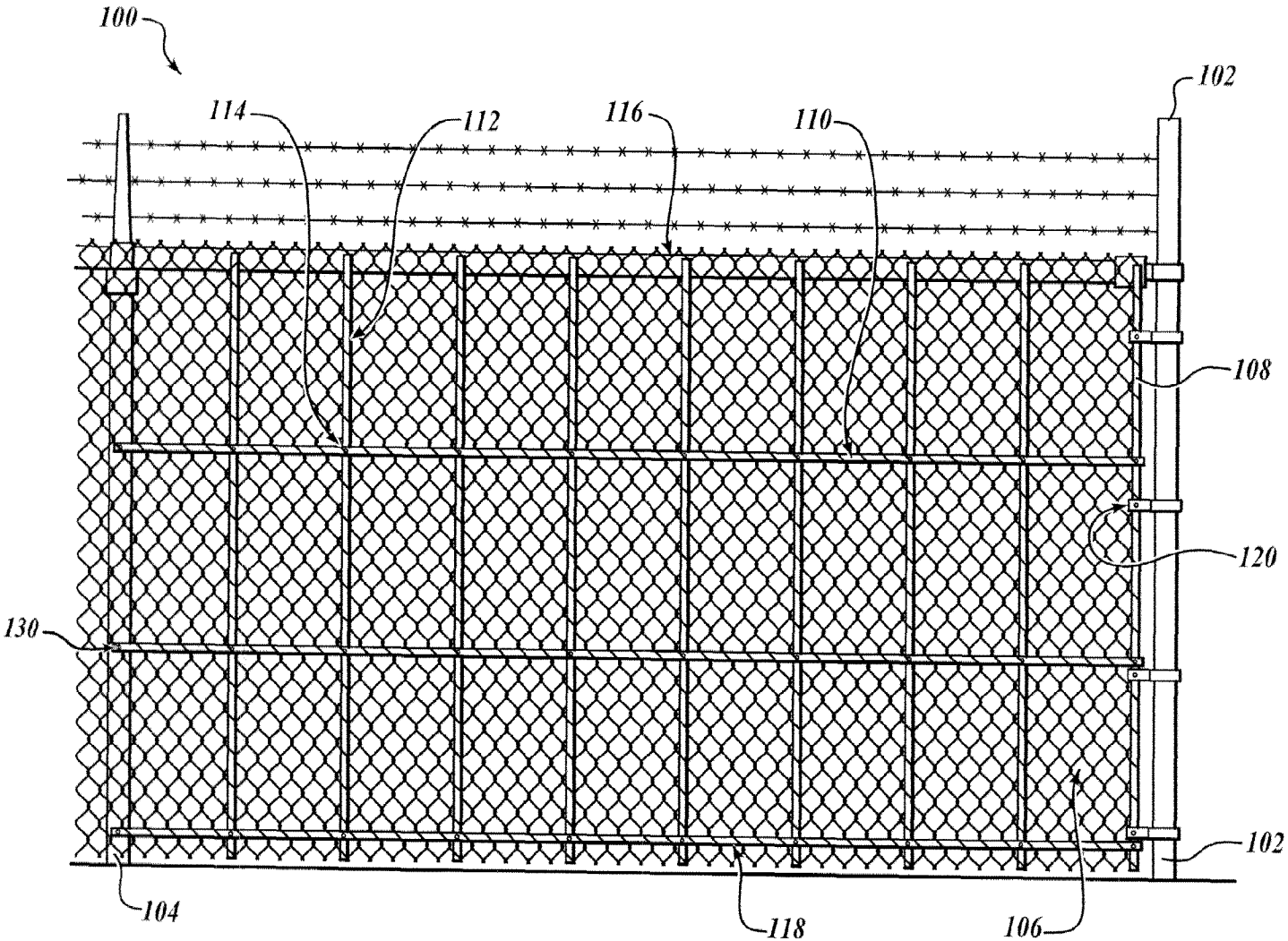
FIG. 1 illustrates a section of a tamper-resistant fence.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 illustrates a tamper-resistant fence. Fence 100 comprises a plurality of (vertical) posts, such as posts 102 and 104. Fabric 106 can be woven wire (such as a "chain link" fabric) and can be positioned between (and/or across) the vertical posts, typically lying in a plane defined by the posts. Spreader bar 108 is inserted into a channel within the fence fabric and is normally securely coupled to a post, for example, by bracket 120. ("Securely coupled" includes using coupling such that the coupling is more tamper-resistant than the mere fence fabric itself is to cutting, for example.) The fence fabric is normally tensioned by exerting a tensile force on the spreader bar and affixing the tensioned fabric to the posts.

Rail 116 typically spans the distance between (and/or beyond) the posts. Typically, the rail is positioned near the top end of the vertical posts although other positions along the length of the post can be used. The rail can be secured by threading the rail through eyes of caps that are affixed to the top of the posts (or by attaching to an end post, such as post 102). The fabric can be affixed to the posts and/or rails by using, for example, wire clips at intermediate locations.

The security of the fence to breaching and/or tampering can be increased by using inserts, such as inserts 110 and 112. A tamper-resistant insert (or "insert" throughout) is substantially resistant to attack by wire and bolt cutters (as compared to standard fence fabric wires).

An example insert can be made of common spreader bar stock that is used for tensioning lengths of fence fabric. Common spreader bar stock is typically elongate and flattened such that it can be easily inserted within a vertical and/or diagonal channel of a woven wire fence (such as chain link fence fabric when tensioned). Inserts that are thicker than common spreader bar stock (or doubled common spreader bar stock) can be used. In other examples, doubled spreader bar stock can be used placed side-by-side within a channel, within an adjacent channel, and/or stacked on top of each other (e.g., having contact between the longitudinal faces of the bars).

As also discussed below, the presence of the insert creates the appearance of a harder-to-breach fence. The appearance of a harder-to-breach fence helps deter would-be breachers from attempting to cut (or otherwise breach) the fence because of the additional time required to breach the fence. Increasing the time that would be required to breach the fence also increases the likelihood that the trespasser would be caught, which thus helps to deter the attack on the fence.

Figure 2:
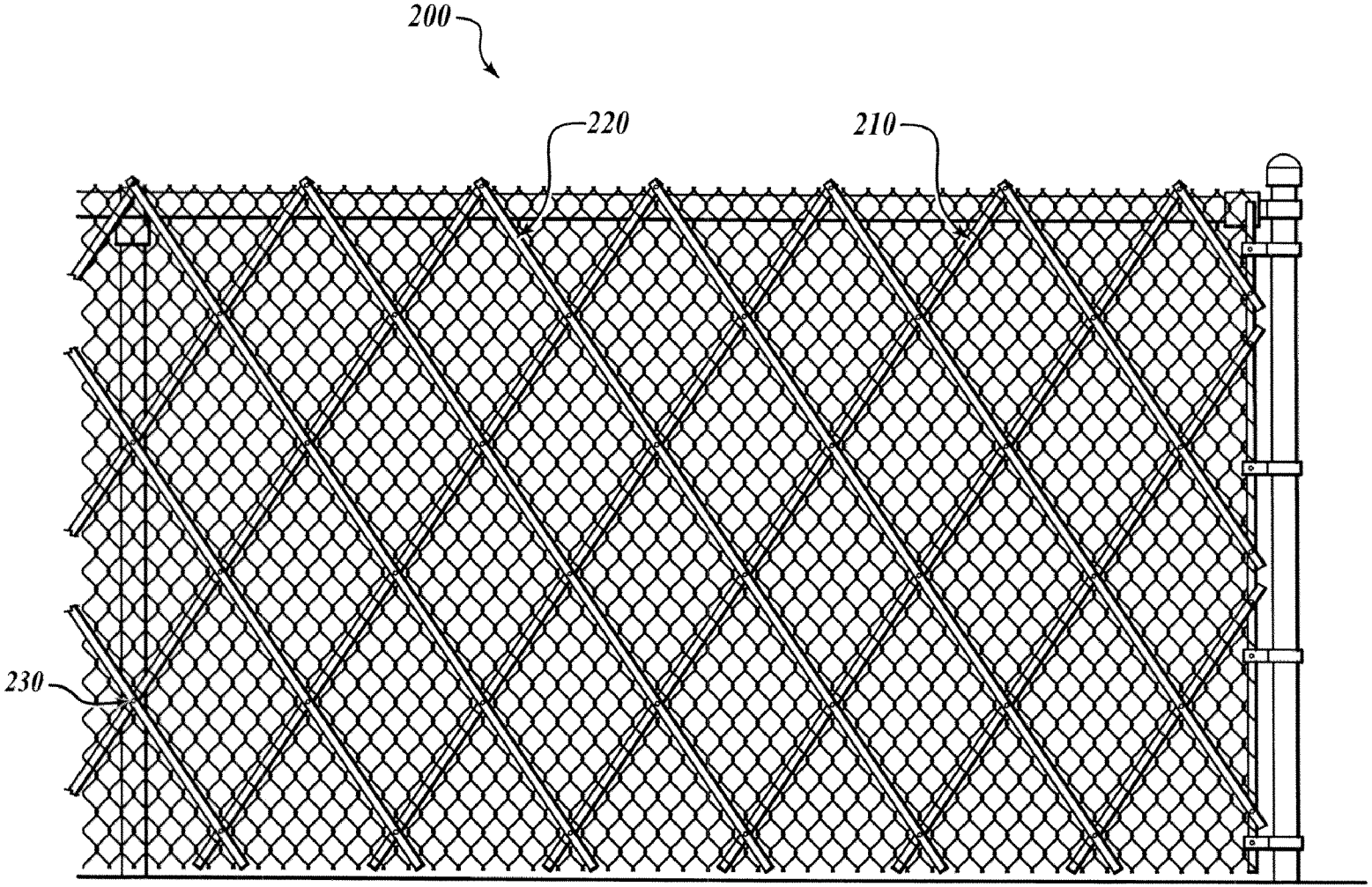
FIG. 2 illustrates a section of another example tamper-resistant fence.
Figure 3:
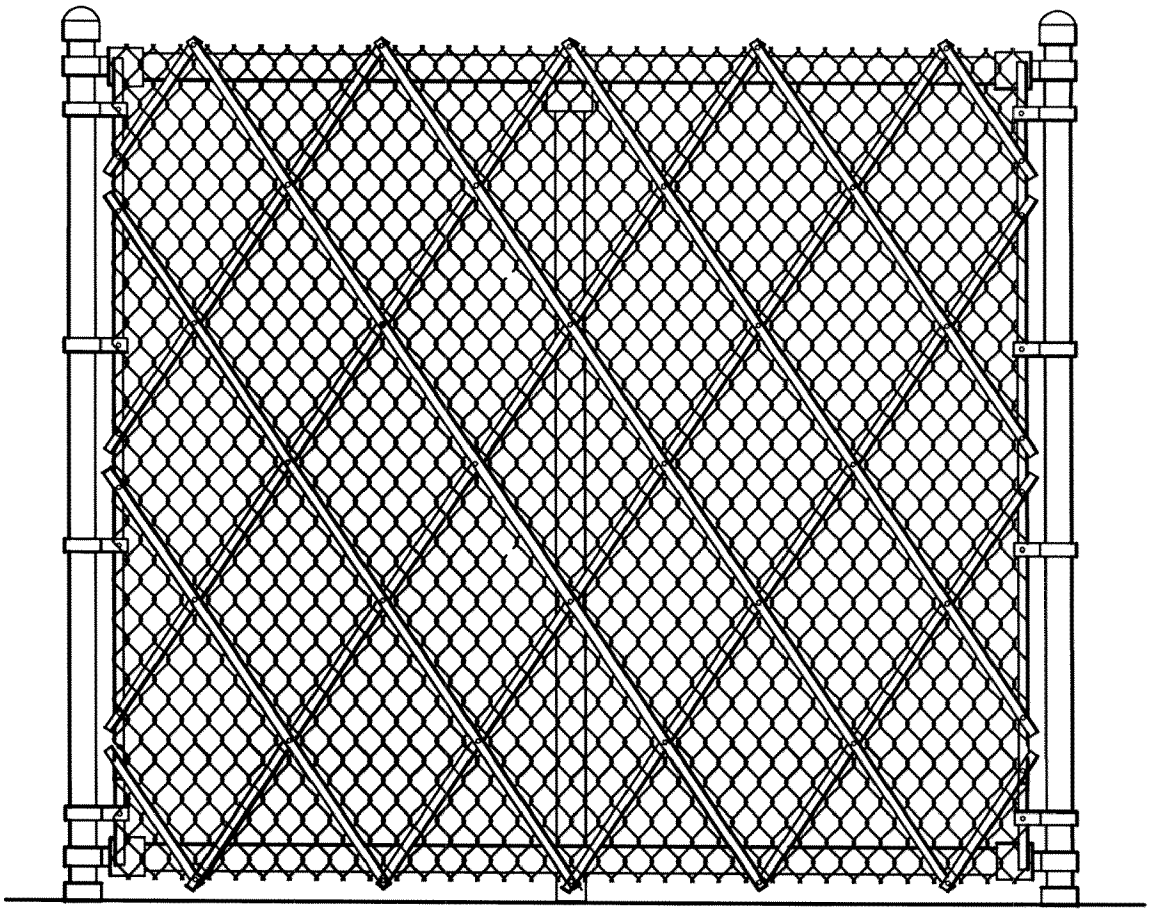
FIG. 3 illustrates a section of yet another example tamper-resistant fence.

An insert can be threaded through a vertical channel such that the insert lies within (front-to-back, for example) a helical coil of the fence fabric. An insert can also be laid within (and/or partially within) a diagonal channel such that the insert (and/or a portion thereof) lies between the depth (e.g., in a front-to-back direction) extent of the fence fabric. Additionally, inserts can be laid across the face of the fence fabric and attached to other inserts such that the fabric and inserts are interwoven. (As shown in FIG. 2 below, the fence fabric and inserts can be captivated by securely coupling inserts from opposing sides of the fence to each other.) Interweaving the inserts with the fence fabric captivates the inserts so that the inserts cannot be merely pulled away from the fence fabric.

The inserts increase the strength (and the appearance of strength) of the fence such that the length of time to breach a fence estimated by a potential breacher is increased. The security is increased because a potential breacher may be deterred when the time estimated for breaching substantially increases the chances of being caught "in flagrante delicto." For example, a potential breacher may decide not to breach the fence when the estimated time for breaching the fence is increased more than twofold.

As shown in FIG. 1, horizontal inserts 110 and vertical inserts 112 are used. More or less inserts than shown in the Figure can be used. Typically, vertical inserts 112 are threaded through vertical channels in the fence fabric, while horizontal inserts 110 are placed across the face of the fence fabric. The vertical inserts 112 and the horizontal inserts 110 form intersections 114. Intersections 114 are formed when an insert having a first orientation intersects (overlaps or otherwise coincides with) an insert having a second orientation. The intersection can be defined by the angle (which is normally other than an integer multiple of 180 degrees) formed by the relation of the orientations of the first and second inserts.

The intersections can be used to securely couple two intersecting inserts to each other by any suitable means such as welding, bolting, riveting, gluing, lashing, and the like. All intersections need not be secured.

Coupling inserts of differing orientations together can be used to secure the inserts to the fence fabric. For example, threading a vertical insert through a vertical channel (formed by a helix of woven fence wire, for example) allows the insert to be freely moved in a vertical direction while being relatively captivated in a front-to-back or a side-to-side direction. Affixing a horizontal insert to the vertical insert captivates the vertical insert from moving in a vertical direction because the securely coupled inserts of differing orientations are interwoven with the fence fabric.

A bolt 130, for example, can be used to secure an insert to a post. Securing the insert to a post increases the security of the fence because, for example, merely cutting the fence fabric does not allow the insert to be moved from the plane of an intact fence, which might provide sufficient space to move under (or around) and gap created.

Additional sets of parallel inserts can be securely coupled together to form a grid in which openings can be minimized by the arrangement of the inserts. The inserts can be arranged such that, for example, the openings between parallel inserts are smaller than a human, a child, or stolen objects, and the like, could traverse (assuming the absence of an intact fence fabric).

The vertical inserts can be extended beyond the bottom of the fence fabric. A horizontal "insert" can be placed across portions of the vertical inserts that extend beyond the bottom of the fence fabric and securely coupled thereto. Extending the grid beyond the bottom (or top, for example) of the fence increases the security of the fence by making it harder to traverse under (or over) the fence.

In FIG. 2, a first set of parallel inserts 210 can be laid in concave channels running in a diagonal direction within a front-side face of the fence fabric. A second set of parallel inserts 220 can be laid across the backside face of the fence (for example, in the backside diagonal channel or horizontally across the backside face of the fence) and securely coupled to the first insert such that at least a portion of the fence is disposed between the first and second inserts. Thus the inserts can be captivated by the fence fabric. Extending the inserts above the top or bottom of the fence can form sharp protrusions that can make it harder to harder to traverse under (or over) the fence.

The inserts can be securely coupled to posts either directly (using a bracket attached to a post) and/or indirectly by using, for example, a spreader bar (that is often present in conventional fences) that is securely coupled to a post (by a bracket, for example). The inserts can also be securely coupled to a fence rail, if any.

In fence 100, insert 108 is a spreader bar attached to post 102 using brackets that clamp the spreader bar to post 102. The brackets can use tamper-resistant bolts (for example) to increase security. Horizontal insert 118 can be securely coupled to post 102 or 104, for example, by directly welding or bolting to the post (as shown by bolt 230). Inserts from either or both sets of parallel inserts (210 and 220) can be bolted using a single bolt (230) wherever an insert substantially overlaps a post. As discussed above, inserts are securely coupled to each other to form a secure grid. By securely coupling the grid to two posts, the grid and posts form a barrier that cannot be easily breached merely by cutting the fence fabric.

Additional fence sections can be likewise be enhanced by forming grids in adjoining fence sections by using a common post to anchor adjacent secure grids. By securely coupling adjoining fence sections, a secured fence line can be arranged. The secured fence line can be, for example, a perimeter fence (which may include a gate), or a fence abutting a secure structure such as a building.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A tamper-resistant fence, the fence comprising:

a first end post and second end post;

a top rail and a bottom rail fixedly coupled to the first and second end posts;

a middle post arranged between the first and second end posts, wherein the middle post is arranged to support the top rail;

fence fabric arranged between the first and second end posts, wherein the fence fabric is metal wire that is woven to form a matrix of openings defining a plurality of diagonally left-leaning concave channels and a plurality of diagonally right-leaning concave channels; and a tamper-resistant grid, comprising:

a first set of metal tamper-resistant inserts, wherein each of the first set of tamper-resistant inserts is arranged diagonally in alignment with one of the right-leaning concave channels on a first side of the fence fabric, wherein at least one right-leaning concave channel of the fence fabric that does not have a tamper-resistant insert arranged therein is interposed between adjacent members of the first set of tamper-resistant inserts; and a second set of metal tamper-resistant inserts, wherein each of the second set of tamper-resistant inserts is arranged diagonally in alignment with one of the left-leaning concave channels on a second side of the fence fabric, wherein at least one left-leaning concave channel of the fence fabric that does not have a tamper-resistant insert arranged therein is interposed between adjacent members of the second set of tamper-resistant inserts;

wherein each of the second set of tamper-resistant inserts intersects and is fixedly coupled to at least one of the first set of tamper-resistant inserts;

wherein a plurality of the second set of tamper-resistant inserts each intersect and are fixedly coupled to at least one of the first set of tamper-resistant inserts below the top rail;

wherein a plurality of the first set of tamper-resistant inserts each comprise an upper end which intersects and is fixedly coupled to a respective upper end of one of the second set of tamper-resistant inserts above the top rail;

wherein members of the first and second set of tamper-resistant inserts intersect to form openings in the grid which are smaller than a size that a human can traverse; and wherein ends of a plurality of the first and second set of tamper-resistant inserts are fixedly coupled to the first and second end posts such that opposing sides of the grid are fixedly coupled to the first and second end posts.

2. The fence of claim 1 wherein the first end post is coupled to a second tamper-resistant grid.

3. The fence of claim 1 wherein spreader bar stock is used for the tamper-resistant inserts.

4. The fence of claim 1 wherein each of the plurality of the second set of tamper-resistant inserts that intersect and are fixedly coupled to at least one of the first set of tamper-resistant inserts below the top rail is arranged to intersect by overlapping of one of the first set of tamper-resistant inserts with one of the second set of tamper-resistant inserts.

5. The fence of claim 1 wherein each of the plurality of the second set of tamper-resistant inserts that intersect and are fixedly coupled to at least one of the first set of tamper-resistant inserts below the top rail is fixedly coupled by bolting, welding, riveting, or gluing.

6. The fence of claim 1 further comprising a spreader bar inserted into a vertical channel defined at a side edge of the fence fabric and fixedly coupled to at least one of the first or second set of tamper-resistant inserts.

7. The fence of claim 6 wherein the spreader bar is securely coupled directly to one of the first and second end posts.

8. The fence of claim 1 wherein members of the second set of tamper-resistant inserts are securely coupled directly to one of the first and second end posts.

* * * * *